United States Patent [19]

Break

[11] Patent Number: 4,671,094

[45] Date of Patent: Jun. 9, 1987

[54] PORTABLE SHEET BENDING BRAKE

[75] Inventor: Douglas G. Break, Farmington Hills, Mich.

[73] Assignee: Tapco Products Company, Inc., Detroit, Mich.

[21] Appl. No.: 792,121

[22] Filed: Oct. 28, 1985

[51] Int. Cl.[4] ..... B21D 5/04

[52] U.S. Cl. ..... 72/319; 384/903

[58] Field of Search ..... 72/319-323; 269/229-236, 239, 196, 286; 384/125, 220, 297, 299, 903

[56] References Cited

U.S. PATENT DOCUMENTS

| | | | |
|---|---|---|---|
| 1,020,192 | 3/1912 | Dade | 269/232 |
| 2,277,275 | 3/1942 | Swartz | 269/233 |
| 3,129,938 | 4/1964 | Riley | 269/236 |
| 3,161,223 | 12/1964 | Marsh . | |
| 3,383,899 | 5/1968 | Ercoline et al. | 72/319 |
| 3,481,174 | 12/1969 | Barnack . | |
| 3,482,427 | 12/1969 | Barnack . | |
| 3,559,444 | 2/1968 | Blazey et al. . | |
| 3,712,606 | 1/1973 | Cole | 269/239 |
| 3,817,075 | 6/1974 | Marsh et al. . | |
| 3,997,152 | 12/1976 | Sass et al. | 269/286 |
| 4,081,986 | 4/1978 | Break | 72/320 |
| 4,092,841 | 6/1978 | Chambers, Jr. | 72/320 |
| 4,240,279 | 12/1980 | Rhoades | 72/319 |
| 4,494,397 | 1/1985 | Rhoades | 72/320 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a plurality of C-shaped frame members that support a first member. The first member has a clamping surface. A second member is hinged to the first member and has a bending surface. A plurality of bars are pivoted to the frame members and support an anvil member that extends longitudinally of the first member. A plurality of eccentric cams are secured on a cam support shaft. Each bar is generally C-shaped in cross section and a cam is positioned between the upper and lower flanges thereof. A handle is secured to the shaft such that when the handle is operated, the eccentric cams are rotated to move the bars and, in turn, the anvil member into and out of clamping position with respect to the clamping surface. The cam support shaft is supported on the frame members by plastic bearings fixed in openings on the frame members and having tapered sides such that when the handle is operated to rotate the cams, the cam support shaft is shifted vertically and wedges against the sides of the openings of the plastic bearings. The wedging action accommodates variations in the thickness of the workpiece and locks the cams holding the anvil against the clamping surface.

5 Claims, 6 Drawing Figures

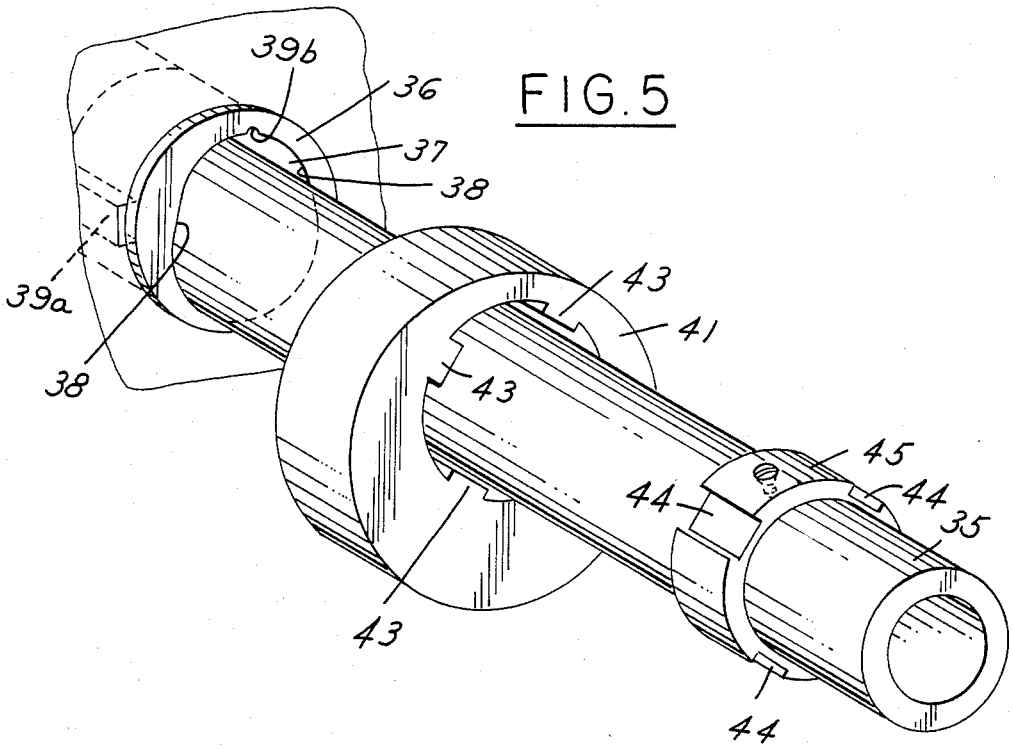
FIG. 5
FIG. 6
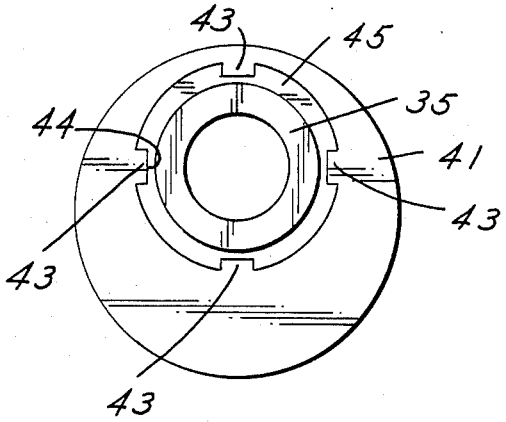

PORTABLE SHEET BENDING BRAKE

The invention relates to sheet bending brakes and particularly to portable sheet bending brakes.

BACKGROUND AND SUMMARY OF THE INVENTION

In the handling of sheet material such as is used for building construction, it has been common in recent times to provide a portable sheet bending brake wherein sheet material is clamped between an anvil member and a clamping surface and a bending member is hinged for bending the sheet material about the anvil member. Typical sheet bending brakes are disclosed in U.S. Pat. Nos. 3,161,223, 3,481,174, 3,482,427, 3,559,444, 3,817,075 and 4,240,279.

As shown, for example, in the aforementioned U.S. Pat. Nos. 3,161,223, 3,559,444, 3,817,075 and 4,240,279, the anvil member is clamped in position by means of a backing plate that has inclined cams underlying a portion of the fixed frame so that when the plate is moved longitudinally by a hand lever, the cams are moved into and out of position clamping and unclamping the backing plate.

In the aforementioned U.S. Pat. Nos. 3,481,174 and 3,482,427, the anvil is supported by pivoted bars that, in turn, are connected by links to a handle that is pivoted on the frame of the brake so that rotation of the handle moves the bars and, in turn, the anvil into and out of clamping position.

It has also heretofore been suggested that eccentric cams be utilized for moving the anvil member into and out of position as shown, for example, in U.S. Pat. Nos. 3,383,899, 4,092,841 and 4,081,986.

One of the problems with prior sheet bending brakes utilizing eccentric cams is that of adjusting the cams on the shaft. Thus, it is common to provide some type of clamp for holding the cams in position. Any such arrangement results in difficulty in adjustment and also the tendency of the clamp arrangement to loosen resulting in a loss of adjustment.

In one arrangement, the cams are adjustably mounted by bolts which can be loosened to permit rotation of the cams about the shaft. Such an arrangement operates satisfactorily but is subject to loss of adjustment in use necessitating frequent adjustment.

In U.S. Pat. No. 4,494,397 the shaft and eccentric cams are provided with circumferentially spaced teeth extending axially so that the cams are locked in any adjusted position. The position of a cam can be adjusted by moving the cam axially relative to the shaft to disengage the teeth on the cam from the teeth on the shaft, rotating the cam to the desired adjusted position and moving the cam axially to reengage the teeth.

Among the objectives of the present invention are to provide a portable sheet bending brake incorporating a novel and an inexpensive construction for adjusting and accommodating to workpieces of different thickness which is low in cost and can be adjusted without the use of tools.

In accordance with the invention, the sheet bending brake has cam support shaft is supported on the frame members by plastic bearings fixed in openings on the frame members and having tapered sides such that when the handle is operated to rotate the cams, the cam support shaft is shifted vertically and wedges against the tapered surfaces of the openings of the plastic members. The wedging action accommodates variations in the thickness of the workpiece and locks the cams holding the anvil against the clamping surface.

DESCRIPTION OF THE DRAWINGS

FIG. 5 is an exploded view of a portion of the brake.

FIG. 6 is an end view of a cam assembly of the brake.

DESCRIPTION

Figure 1:
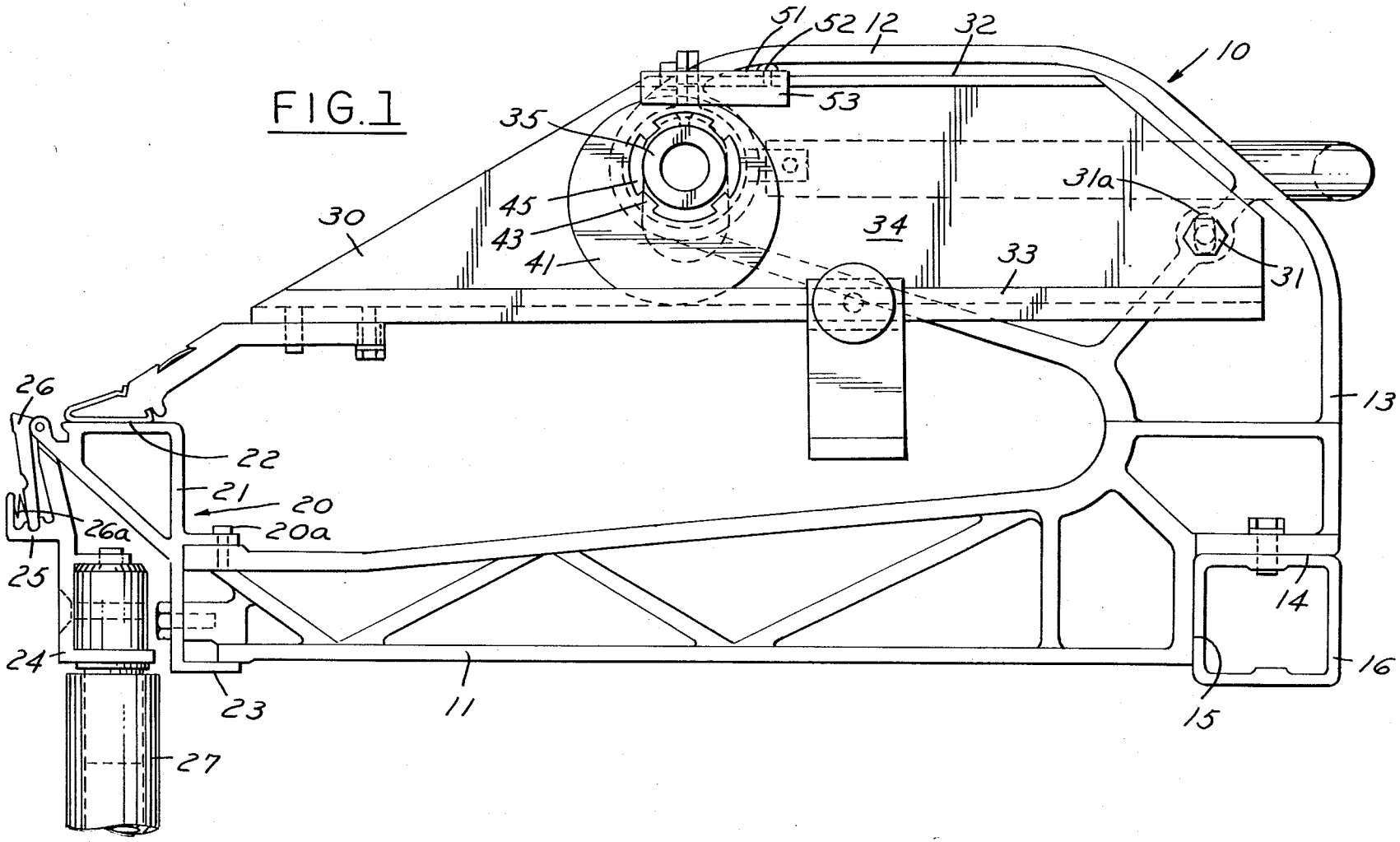
FIG. 1 is a fragmentary side elevational view of a sheet bending brake embodying the invention.
Figure 2:
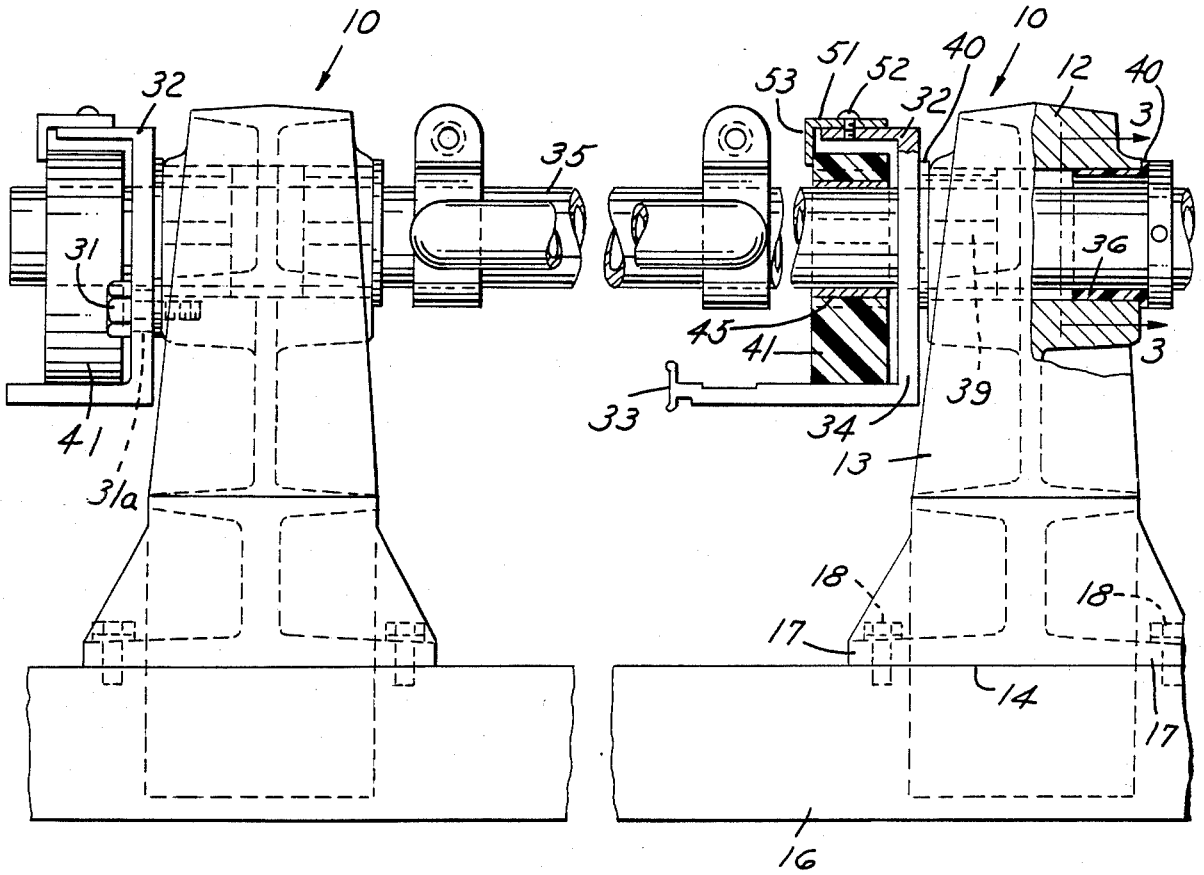
FIG. 2 is a fragmentary part sectional rear elevational view.

Referring to FIGS. 1 and 2, the sheet bending brake embodying the invention comprises a plurality of longitudinally spaced C-shaped frame members 10 which are preferably aluminum castings. Each frame member 10 includes a lower arm 11 and an upper arm 12 with a connecting portion 13, the upper arm 12 being shorter than the lower arm 11. Each frame member 10 includes a rearwardly extending recess or notch defined by a horizontal surface 14 and a vertical surface 15 for receiving an extruded aluminum square rear rail 16. As shown in FIG. 2, portion 13 includes laterally extending flanges 17 overlying the upper surface of the rear rail 16 through which screws 18 extend to fasten the rear rail to the frame members.

A first fixed extruded aluminum member 20 is provided on the front end of the lower arms 11 as presently described and comprises an upper generally triangular portion 21 defining a horizontal clamping surface 22 and a lower C-shaped portion 23 that has upper and lower walls that telescope over the free ends of the lower arms 11. Screws **20*a* fasten the fixed member 20 on the arms 11**.

An extruded aluminum bending member 24 is hinged to a portion of the fixed member 20 by a hinge defined by intermeshing projections on the members 24, 20, respectively. A hinge pin extends through aligned openings in the projections to complete the hinge. The bending member 24 further includes a laterally extending L-shaped portion 25 that receives the lower end of an extruded floating member 26 yieldingly urged by a spring **26*a* against the hinge. The member 26 engages the sheet to be bent and minimizes marring during the bending as more fully described in U.S. Pat. No. 3,481,174 and 3,482,427 which are incorporated herein by reference. The bending member 24 further includes a C-shaped portion that supports an adapter 36 for receiving a tubular handle 27**. Alternatively, the bending member may be hinged in the manner set forth in U.S. application Ser. No. 576,870 filed Feb. 3, 1984, which is incorporated herein by reference.

The sheet bending brake further includes a plurality of extruded aluminum bars 30, a bar 30 being pivoted to each frame member 10 by a bolt 31 extending through a vertical elongated slot **31*a* at the area of juncture of the rear of the arm 12 and the upper part of the connecting portion 13. Each bar 30 includes an upper flange 32, a lower flange 33, and a vertical wall 34. An extruded aluminum shaft 35 is mounted in the forward ends of the upper arms 12 by plastic bearings 36, preferably made of a hard plastic such as nylon, and extend through enlarged openings in the vertical walls of the bars 30**.

Each plastic bearing 36 includes a vertically elongated opening 37 having tapered sides 38 that converge upwardly and diverge downwardly. Each plastic bearing 36 is located by an elongated key 39 in a slot 39*a* of the frame member to hold the bearing in properly oriented relationship. Each bearing 36 further includes a flange 40 for locating the bearing longitudinally. A groove 39*b* provides indicia for indicating the top of the bearing and thereby providing easy orientation. A plurality of plastic eccentric cams 41 are fixed on shaft 35 so that they are positioned between the upper and lower flanges 32, 33 of each bar.

The bars 30 support an anvil member 42 that includes an upper horizontal portion bolted to the lower flange 33 of the bars.

Each eccentric cam 41 as axially extending and radially inwardly extending circumferentially spaced ribs 43 that engage complimentary slots 44 in a collar 45 fixed at the desired point along the shaft 35 where the cam is to be located.

A retainer 51 is removably fastened to the upper flange 32 by a screw 52 and has a downwardly extending lip 53 which retains the cam 41 against axial movement during normal operation.

Figure 3:
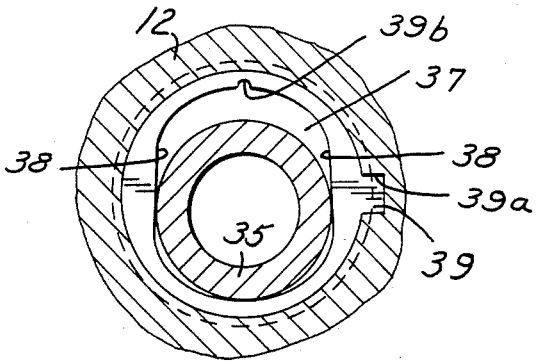
FIG. 3 is a fragmentary sectional view taken along the line 3—3 in FIG. 2.
Figure 4:
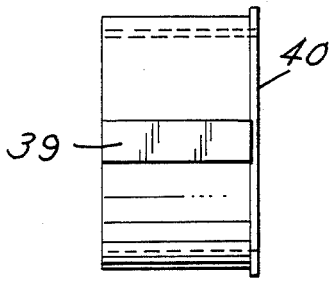
FIG. 4 is an end perspective view of a part of the sheet bending brake.

In operation, when a workpiece has been placed in positioned for clamping and bending, the handle is grasped rotating the shaft 35. Rotation of the shaft rotates the cams causing the cams to move the bars 30 downwardly to clamp the workpiece so that the bending member can thereafter be rotated. During this movement and after the anvil engages the workpiece, continued rotation of the shaft 35 causes the shaft to rise vertically as viewed in FIGS. 1, 2 and 3 wedging the shaft in the opening 37. This will cause the construction to accommodate for variations and thickness of the workpiece without any additional adjustment. The provision of the elongated slot 31*a* at the rear pivot of the bars 30 permits initial adjustment during set up to accommodate substantial variations in thickness of the workpiece.

Although the construction shown and described herein has particular utility in the clamping of a workpiece in a sheet bending brake, the invention is also applicable in the clamping of other workpieces which need to be clamped securely and wherein there may be variations in tolerances.

I claim:

1. A sheet bending brake comprising a first fixed member defining a clamping surface extending longitudinally, a second bending member, means hinging said bending member to said fixed member for moving said anvil toward and away from said clamping surface on said fixed member, an anvil member extending longitudinally of said sheet bending brake and movably mounted on said bending member for movement toward and away from the clamping surface, a cam support shaft mounted on said fixed member, a plurality of eccentric cams fixed on said shaft and positioned for engaging said anvil member such that rotation of said shaft pivots said anvil member into and out of clamping position, said fixed member having longitudinally spaced openings for rotatably supporting said cam support shaft, bearings fixed in said openings on the fixed members, said bearings having elongated openings through which said cam support shaft extends for rotatably supporting said cam support shaft for rotation on said fixed member, each bearing opening receiving only said cam support shaft and each bearing opening having fixed dimensions and including tapered sides which converge upwardly away from said clamping surface such that when the shaft is rotated to rotate the cams, the cam support shaft is shifted vertically and wedges against the sides of the openings of the bearings, and the wedging action accommodates variations in the thickness of the workpiece and locks the cams holding the anvil against the clamping surface.

2. The sheet bending brake set forth in claim 1 wherein said tapered sides comprise flat surfaces.

3. The sheet bending brake set forth in claim 1 wherein said bearings are ring shape and made of plastic, said frame members and plastic bearings have interengaging means for holding said plastic bearings in proper circumferential position on said frame members.

4. The sheet bending brake set forth in claim 1 wherein said bearings are made of plastic, said plastic bearings include indicia means for indicating the proper orientation of the plastic members in said openings in said frame members.

5. The sheet bending brake set forth in any of claims 1–4 wherein said anvil members are pivoted to said frame members for swinging movement toward and away from the clamping surface.

* * * * *